United States Patent [19]

Cassidy

[11] Patent Number: 4,471,904

[45] Date of Patent: Sep. 18, 1984

[54] COLLAPSIBLE CONTAINER

[75] Inventor: Benjamin J. Cassidy, Waldwick, N.J.

[73] Assignee: International Paper Company, New York, N.Y.

[21] Appl. No.: 436,125

[22] Filed: Oct. 22, 1982

[51] Int. Cl.[3] ..... B65D 5/36

[52] U.S. Cl. ..... 229/41 B; 229/16 R; 229/37 R

[58] Field of Search ..... 229/41 R, 41 B, 41 C, 229/41 D, 16 R, 37 R, 39 B

[56] References Cited

U.S. PATENT DOCUMENTS

| | | | |
|---|---|---|---|
| 797,113 | 8/1905 | Hiers et al. | 229/41 B |
| 1,558,155 | 10/1925 | Flansburg | 229/41 B |
| 3,369,729 | 2/1968 | Stopper | 229/16 R X |
| 4,267,955 | 5/1981 | Struble | 229/41 B X |

FOREIGN PATENT DOCUMENTS

| | | | |
|---|---|---|---|
| 1603509 | 11/1981 | United Kingdom | 229/37 R |
| 2084961 | 4/1982 | United Kingdom | 229/41 B |

*Primary Examiner*—William Price
*Assistant Examiner*—Gary E. Elkins
*Attorney, Agent, or Firm*—Richard J. Ancel

[57] ABSTRACT

A knock-down paperboard container and blank for forming it. The container has a recessed bottom whose four corners are provided with webs glued to the container ends. The carton exhibits special utility in the packaging of grease laden foodstuffs such as fried chicken. Both the recessed bottom and its webbed corners inhibit dripping of grease from the container onto clothing and tables. The knock down capability is useful in fast food retail outlets where the collapsed containers are rapidly erectable for the reception and dispensing of foodstuffs.

7 Claims, 6 Drawing Figures

COLLAPSIBLE CONTAINER

BACKGROUND OF THE INVENTION

This invention relates to containers and more particularly to collapsible or knock-down containers fashioned from paperboard or like stiff, foldable and resilient sheet material.

The paperboard container art is already aware of collapsible containers. For example, U.S. Pat. No. 2,943,780 issued to Bolding discloses a collapsible bottom wall construction for a container, the bottom wall formed by separate panels sliding together as in the manner of an iris aperture stop for a camera lens. Such containers exhibit the desirable feature of ease and rapidity of being erected from a collapsed condition. Another example of a collapsible container formed of paperboard or the like is illustrated in U.S. Pat. No. 2,430,755 issued to Bergstein. In that construction, unlike the construction of Bolding, the bottom forming portion is smooth and continuous.

While apparently satisfactory for the intended uses described in these patents, such constructions have not been totally satisfactory in certain applications. For example, in fast food retail outlets, which dispense greasy foodstuffs such as fried chicken, the grease will sooner or later seep or wick through the paperboard. This can result in food stains on the clothing of the purchaser or wicking onto a table top supporting the container. Accordingly, an iris aperture stop type construction, such as that of Bolding, would be unsatisfactory because of the discontinuities of the bottom wall of the container. While a bottom construction such as shown in the Bergstein patent is superior in this respect, the problem of wicking through the paperboard persists and accordingly grease stains on clothing or grease on the top of a table may result.

SUMMARY OF THE INVENTION

According to the practice of this invention, the undesirable effects of wicking from grease laden foodstuffs is minimized by the use of a container having a continuous bottom, the bottom having webs at its four corners to inhibit undesirable soiling of clothing and table tops. Further, the container is easily erected from its flattened configuration to receive and package the greasy foodstuffs. The top closure of the container of this invention may be formed in several ways, such as in the manner illustrated in the Bergstein patent, or in a manner similar to that illustrated by the top closure of U.S. Pat. No. 3,365,114 issued to Macchi.

In carrying out the invention, it has been found convenient to fashion the container from a one piece blank to thereby facilitate its formation by automatic machinery if desired. It will be understood, however, that the container may be formed by hand from its blank, to arrive at the collapsed condition of the container. Thereafter, the containers may be shipped in flattened form to retail outlets, such as fast food retail outlets.

The full nature of the invention will be understood from the accompanying drawings and the following description and claims. It should be understood, however, that reference in the following description to front, rear, side, left, right, top, bottom, upper or lower panels or walls are for convenience of description, and such terms are not intended to be used in a limiting sense.

DETAILED DESCRIPTION OF THE INVENTION

Figure 1:
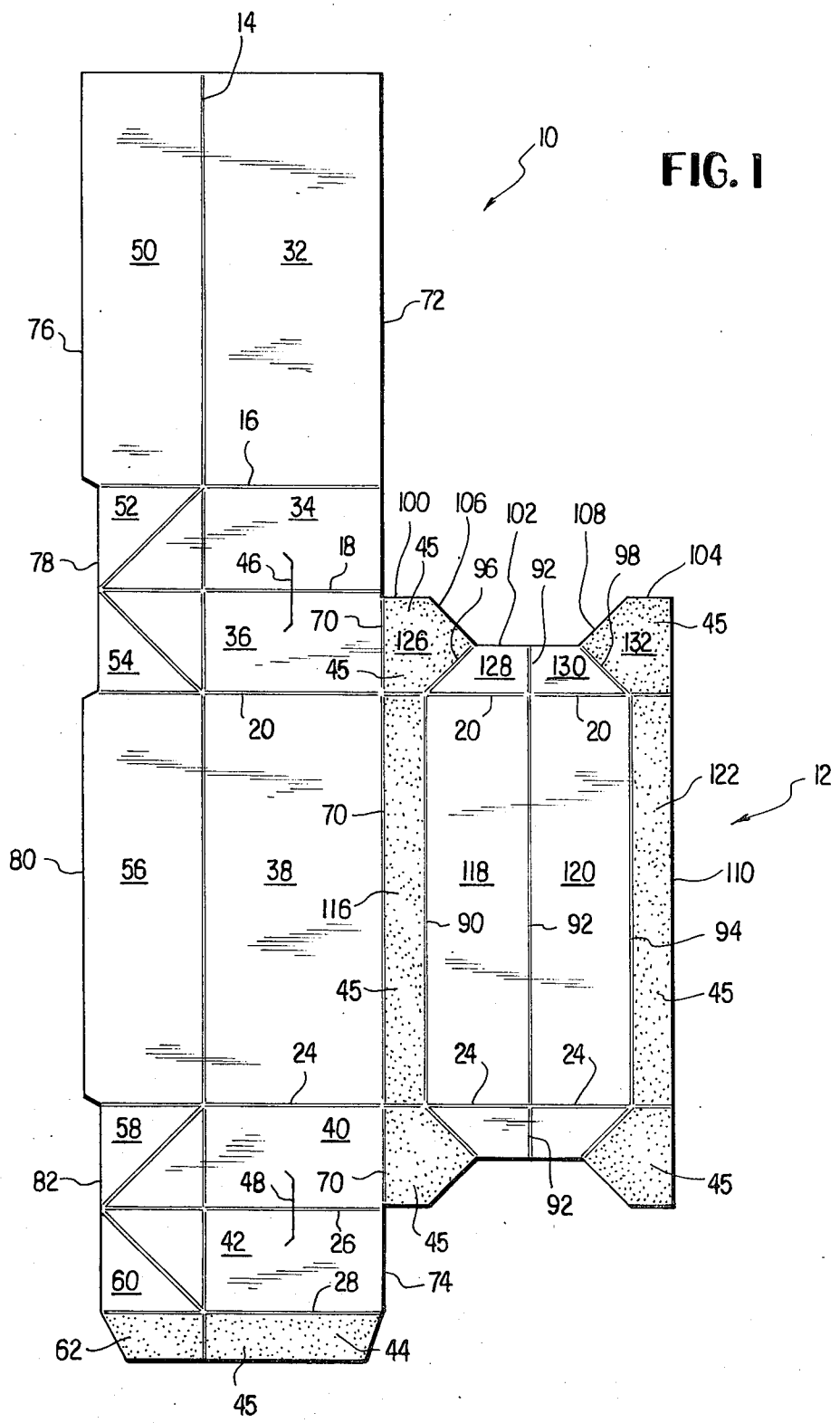
FIG. 1 is a view showing the blank from which the container of this invention is formed.

Referring now to FIG. 1 of the drawings, the blank from which the container of this invention is formed is illustrated. The numeral 10 denotes the container top, side wall and end wall forming portion of the blank, while the numeral 12 denotes generally the container bottom forming portion of the blank. The blank is fashioned from sheet material having the properties of stiffness, resilience and foldability, and is preferably formed of paperboard or the like. The paperboard may contain one or more coatings or be so treated as to render it more resistant to wicking of liquids therethrough.

Considering now portion 10, the numeral 14 denotes a vertical score line running longitudinally completely along the length of the blank. The numerals 16, 18, 20, 24, 26 and 28 denote horizontal score lines transverse to score line 14, and having the indicated horizontal extent. The numerals 32, 34, 36, 38, 40, 42, and 44 denote panels defined by these transverse score lines and longitudinal score line 14. The numerals 46 and 48 denote two cuts extending through the paperboard. Cut 46 spans panels or portions 34 and 36 which together form an end wall forming panel bisected by horizontal score or fold line 18, and the cut 48 spans panels or portions 40 and 42 which together form an end wall forming panel bisected by horizontal score or fold line 26. Cuts 46 and 48 define tab receiving slits, as will later be described. The numerals 50, 52, 54, 56, 58, 60 and 62 also denote panels defined by the intersection of these transverse score lines with longitudinal score line 14, this latter group of panels being shown in the left of score line 14 as viewed at FIG. 1. Panels 62 and 44 define a so-called manufacturer's flap, i.e., a tab or flap to connect endmost panels to form a completed tubular portion of a container. The numeral 72 denotes the upper right hand free edge of portion 10, the numeral 70 denotes a vertical score line, while the numeral 74 denotes the lowermost right free edge of portion 10. The numerals 76, 78, 80 and 82 denote the indicated left free edges of portion 10.

Referring now particularly to portion 12 of the blank of FIG. 1, the numerals 90, 92 and 94 denote vertical score lines extending between transverse score lines 20 and 24. The numerals 96 and 98 denote continuations, at an angle to the horziontal, of score lines 90 and 94, at both edges of portion 12. The numerals 100, 102, 104, 106 and 108 denote the indicated edges of the top edge of portion 12. The numeral 110 denotes the right hand free edge of portion 12, while numerals 116, 118, 120 and 122 denote rectangular bottom wall sub-panels defined by score lines 70, 90, 92, 94 and edge 110. For reasons which will later become apparent, bottom wall sub-panels 116 and 122 may be termed recess forming bottom panels. The numerals 126, 128, 130 and 132 denote extension panels which extend from and are foldably connected to the ends of the bottom wall sub-panels. The outermost pairs of the extension panels are 126, 128 and 130, 132. The innermost pairs of the extension panels are 128, 130. Similar nomenclature applies to panels 116, 118 and 120, 122 (the outermost pairs) and 118, 120 (the innermost pair). In FIG. 1, only the elements of the top edge of portion 12 have been numbered, it being understood that the lower edge of portion 12 is symmetrical (mirror image along a horizontal axis midway between the two edges) and would bear corresponding reference numerals. The stippling 45 on panels 126, 116 and 132, 122 denotes adhesive on one side thereof.

Those portions to the left of longitudinally running score line 14 of portion 10 define a top or closure portion for the container, as will hereinafter be described. In the event that a closure such as shown in the noted Larson patent is employed, panels 52, 54, 58 and 60 are provided with the indicated diagonally oriented score lines running from one corner to the other of these respective panels in the manner indicated. It will be understood, however, that the configuration of portion 10 to the left of score line 14 may be modified so as to provide the container with any desired top closure or cover.

Figure 2:
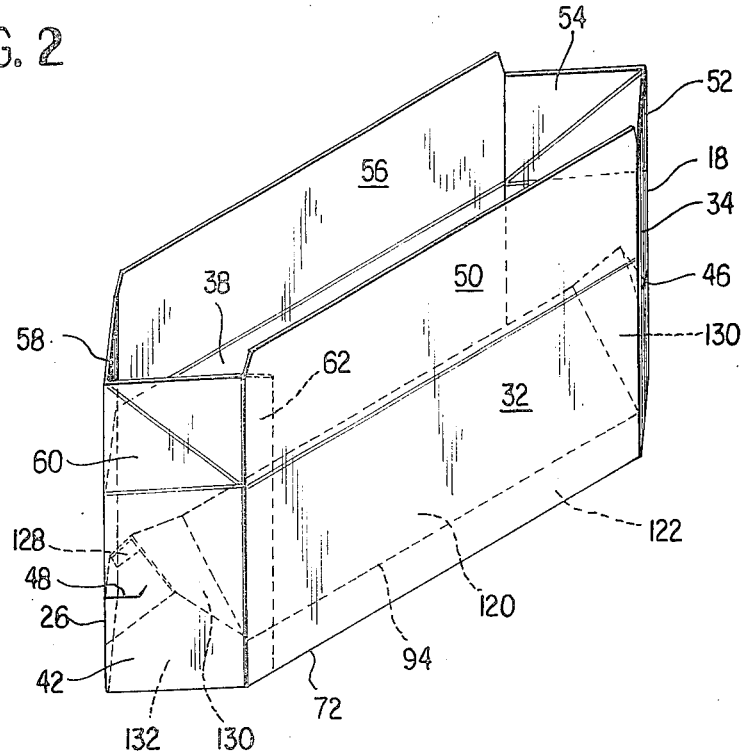
FIG. 2 is a perspective view, partially in phantom lines, illustrating an intermediate step in the setting up and erection of the container of this invention from the blank shown at FIG. 1.

Referring now to FIG. 2 of the drawings, the carton formed from the blank of FIG. 1 is shown as partially erected. In order to arrive at the configuration shown at FIG. 2 from the blank of FIG. 1, the blank is folded about its transverse score ines 16, 18, 20, 24, 26 and 28, with manufacturer's flap 44, 62 also being provided with adhesive 45 and folded upon and adhered to the upper edge of panels 32, 50, thus forming a tube-like structure. Extension panels 126 of bottom wall sub-panel 116 are folded about fold ine 70 and adhered to, respectively, panels 36 and 40, the crossed lines against denoting adhesive. Extension panels 132 of bottom wall forming sub-panel 122 are adhered to, respectively, panels 34 and 42. Referring now to the lower portion of FIG. 2, certain of the bottom wall sub-panels and the extension panels are indicated in phantom lines to illustrate the construction. Thus, one of the extension panels 132 is glued to the interior of panel 42, while the other extension panel 132 is glued to the interior of panel 34. Rectangular bottom wall sub-panel 122 is folded back upon and glued to the lower interior edge portion of panel 32. Similarly, rectangular bottom wall sub-panel 116 is folded back and glued against the lower interior surface of panel 38. Fold lines 70 and edges 72 and 74 form the lowermost portions of the end walls of the completed container.

Figure 3:
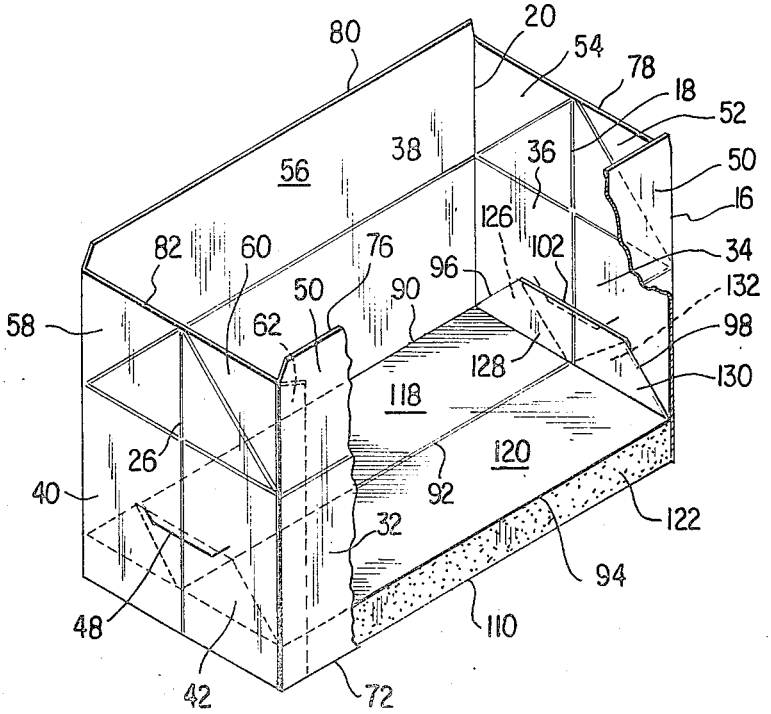
FIG. 3 is a partially broken away perspective view showing the container of FIG. 2 in the fully erected position, prior to the formation of the top closure for the container.

Referring now to FIG. 3 of the drawings, the container has been shown as fully erected from the position shown at FIG. 2, a position derived from FIG. 2 by pressing together the ends, i.e., pressing together fold lines 18 and 26. As shown at FIG. 3, the rectangular bottom wall sub-panels 118 and 120 define a continuous (non-perforate) bottom wall for the container. FIG. 3 also shows the spacing of the bottom panels 118, 120 from the lower edges of the container by rectangular bottom wall sub-panel 122 being folded back upon and adhered to the interior portion of panel 32. The far side of the bottom wall is similarly spaced by counterpart sub-panel 116. The lower right hand portion of FIG. 3 illustrates the position of extension panels 126 and 132 as glued to, respectively, panels 36 and 34. The reader will observe that the gluing of extension panels 126 and 132 to panels 34, 36 (the right of FIG. 3), 40, 42 (the left of FIG. 3, but not seen) establishes webs at the four corners of the bottom. Edges 102 of portion 12 are in contact with the end walls 34, 36 (and 40, 42 but not illustrated at FIG. 3). However, there is no gluing of edge portion 102 to the end walls.

Figure 4:
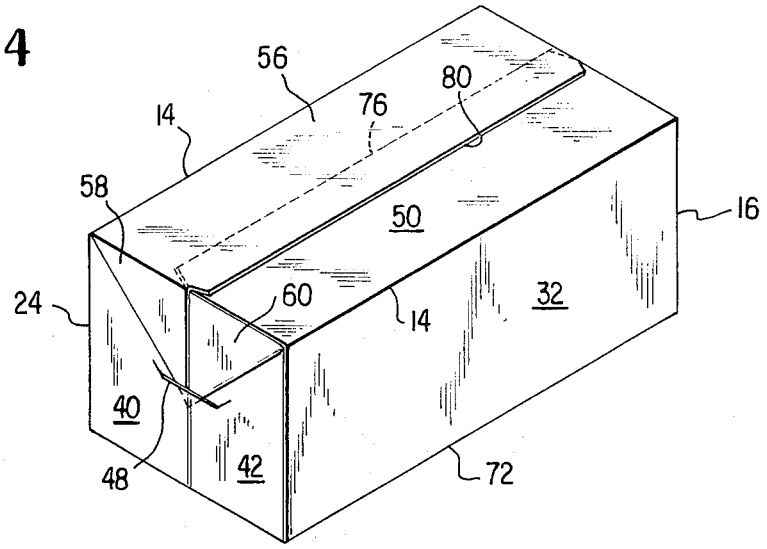
FIG. 4 is a perspective view, similar to FIG. 3, of the container of this invention in its final configuration.

FIG. 4 illustrates the container in its closed configuration.

As shown, for example, in the noted Macchi patent, to effect closure it is only necessary to bend the uppermost portions of fold lines 18 and 26 away from each other, with the diagonal score lines in panels 52, 54, 58 and 60 bowing outwardly. Edge 76 lies underneath edge 80, with triangular, tab-like free ends of folded panels 58, 60 tucked in slit 48 as shown at FIG. 4. The triangular, tab-like free ends of folded panels 52, 54 are, similarly, tucked in slit 46, though not visible in FIG. 4. The slits 46 and 58 thus releasably secure the container in its closed configuration. For opening the noted triangular, tab-like free ends are removed from the slits 46, 48.

Figure 6:
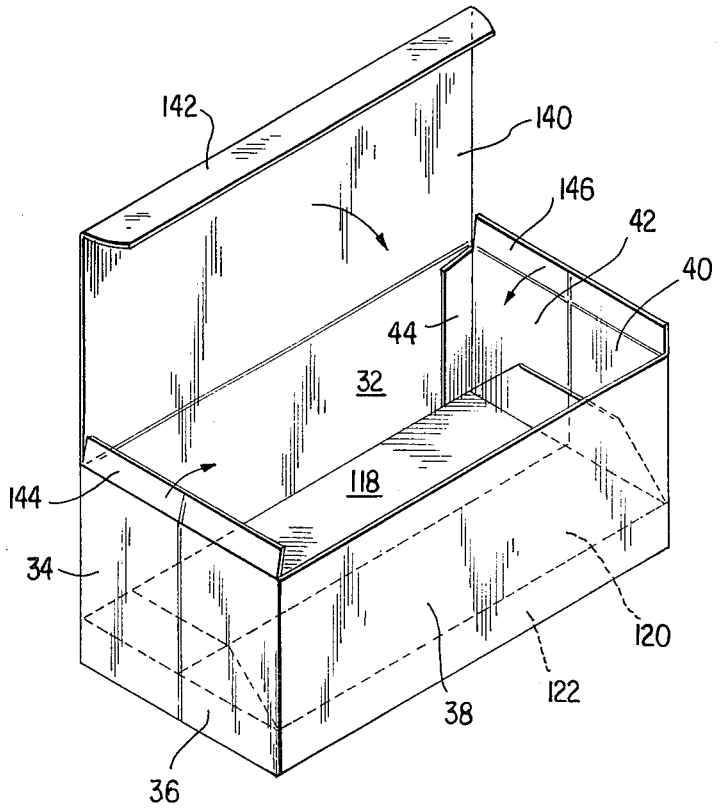
FIG. 6 is a persepctive view of a container, formed from the blank of FIG. 5, just prior to its final closing.
Figure 5:
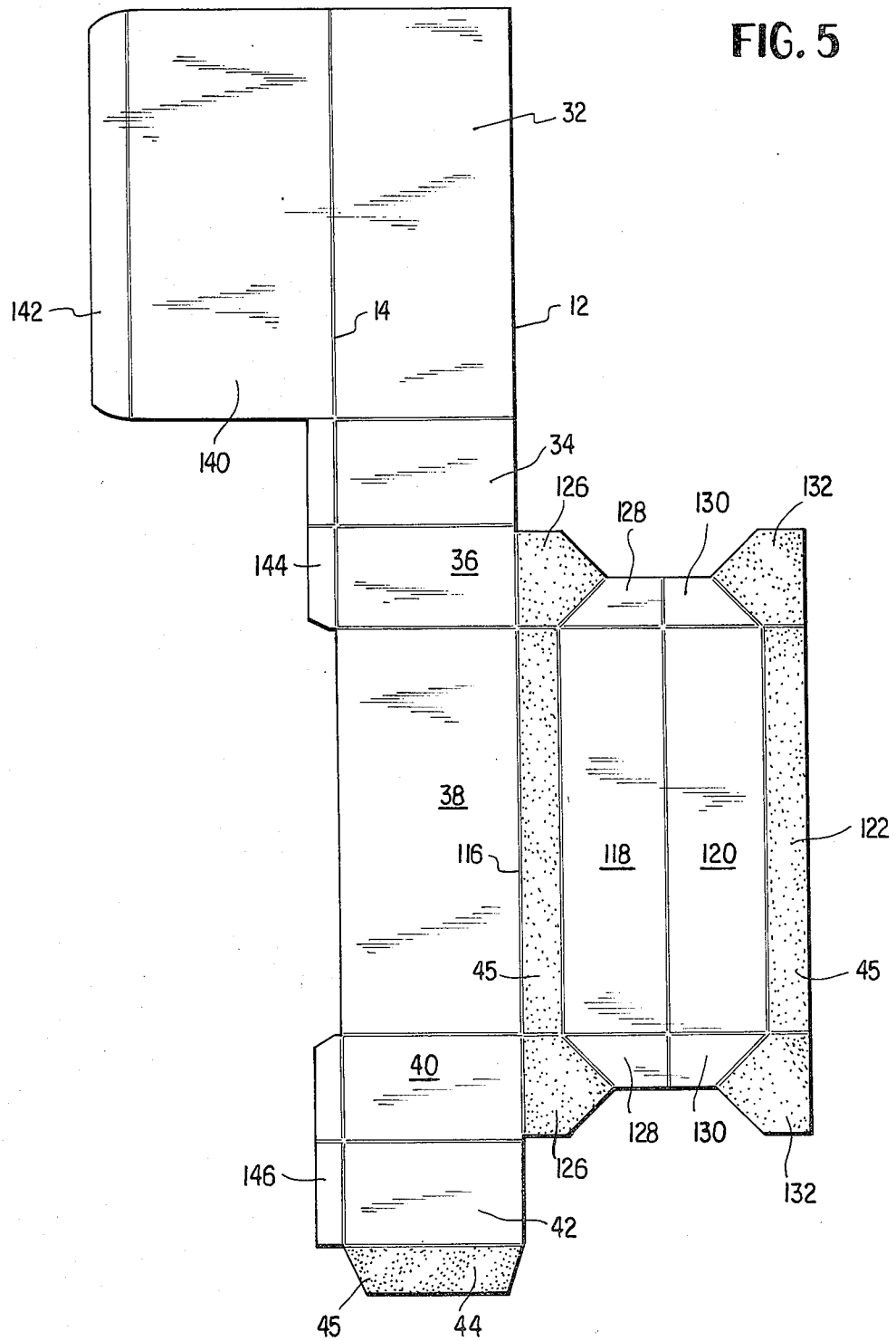
FIG. 5 is a view similar to FIG. 1 and illustrates a modification.

Referring now to FIGS. 5 and 6 of the drawings, another embodiment of the invention is illustrated. The esential difference between these two embodiments is in the top closure. The embodiment of FIGS. 5 and 6 illustrates a tuck-type closure. Referring now to FIG. 5, the elements to the right of vertically running score line 14 are identical to those to the right of score line 14 of the embodiment shown at FIG. 1, with the exception of the absence of slit-forming cuts 46 and 48 which are present in the blank of FIG. 1, but not in the blank of FIG. 5.

Referring now to those elements to the left of score line 14 of FIG. 5, the numeral 140 denotes a top closure panel carrying a tuck-flap 142 at its left edge, the flap defined by the indicated score line. The numeral 144 denotes a closure flap carried by the left portion of panels 34 and 36 and separated therefrom by score line 14. The numeral 146 denotes a similar closure panels and is carried by the left portion of panels 40 and 42 and also separated therefrom by score line 14. The lower portion of panel 42 carries the manufacturer's flap or tab 44, this tab being provided with adhesive 45 as indicated by the stippling.

The blank of FIG. 5 is folded in a manner similar to that of FIG. 1, to reach the position indicated at FIG. 6. Namely, the bottom construction of the container is the same, and accordingly the same reference numerals have been applied to those elements to the right of score line 14 of FIG. 5. From a consideration of FIG. 6 the reader will readily visualize that after the blank has been folded in the manner described with respect to the first embodiment, the cover panel 140 is in the position showed at FIG. 6, with closure panels 144 and 146 adapted to be bend inwardly, as shown by the arrows at FIG. 6 to assume a substantially horizontal position. Next, panel 140 and tuck panel 142 are swung to the right, as indicated by the arrow, to effect final closure. From a comparison of FIGS. 2 and 6, the reader will readily visualize that the cotainer of this second embodiment is collapsible in a manner identical to that described with respect to the first embodiment.

Namely, the ends of the container are simply bowed outwardly and the container is collapsed by pressing the front and rear panels together.

The carton, which is preferably formed from the blank illustrated in FIG. 1, may be made from any suitable foldable material. Preferably, it is made of paperboard or the like, and suitable paperboard stock, for example is 0.014 SBS. The surfaces of the carton may also be coated with barrier materials to aid in retaining the heat and moisture from the product. For example, the exterior of the carton may be coated with a saran-type coating, which acts as a moisture vapor barrier. The interior of the carton may be coated with solvent-based nitrocellulose coatings or with aqueous, modified acrylic coatings, which provide a liquid moisture barrier and a degree of grease resistance. It will be recognized, however, that certain food products will permit the use of uncoated cartons.

Generally speaking, the present invention is directed to a blank and a carton, wherein the blank is formed of foldable sheet material such as paperboard. The blank has two longitudinal and four transverse fold lines, which define a central, bottom-forming panel and two adjoining, side-forming panels, with each side-forming panel having a top-forming panel adjoined thereto. Each end of the top-forming, side-forming and bottom-forming panels have an integral end panel foldably connected thereto. The integral end panels of the side-forming panels each have a diagonal fold line, and the integral end panels of the bottom-forming panel each have two diagonal fold lines. The top-forming panels each have a pair of cut-out flaps adapted to form finger holes.

Although the invention has been described above by reference to preferred embodiments, it will be appreciated that other carton constructions may be devised, which are, nevertheless, within the scope and spirit of the invention and are defined by the claims appended hereto.

What is claimed is:

1. A container formed of stiff, foldable and resilient sheet material such as paperboard, the container being collapsible to assume a folded, flattened shape erectable by the application of forces to its opposite ends, the container including opposed end and side walls, and having a bottom wall, and a top closure to close the container, the container adapted to package grease laden foodstuffs such as fried chicken which results in wicking of grease through the bottom of the container, the container bottom including a fold line running medially thereof and between the end walls to define two rectangular panels, the end walls each having a fold line running medially thereof from the bottom to the top of the container, the outermost longitudinal sides of the two rectangular bottom panels each carrying recess forming bottom panels foldably attached thereto and adhered to the inner, lowermost surface of a corresponding side wall panel to thereby raise the bottom of the container above the level of the lowermost edges of the side and end wall container panels and thereby define a recessed bottom, the recess forming bottom panels carrying at each end thereof extension panels adhered to the inner surface, at regions thereof, of the container end panels.

2. The container of claim 1 wherein the ends of the two rectangular bottom panels each carry extension panels which are foldably connected to the extension panels of the recess forming bottom panels along a diagonal fold line.

3. The container of claim 2 wherein the extension panels of the two rectangular bottom panels are foldably connected to each other along said medial fold line joining the two rectangular bottom panels, the extension panels of the two rectangular bottom panels abutting the interior surface of the end wall panels.

4. A one-piece blank for a knock-down container fashioned from stiff, foldable and resilient sheet material such as paperboard, which comprises: a bottom wall forming panel, first and second side wall forming panels, and first and second end wall forming panels, each first and second end wall forming panel comprising two portions bisected by a fold or score line, said bottom forming panel joined to the first side wall forming panel along a common fold line, the bottom forming panel being of generally rectangular form and having four parallel and rectangular bottom wall sub-panels foldably joined together along their longitudinal sides and defined by three parallel fold lines, one of which runs medially of the bottom forming panel, the ends of the generally rectangular bottom forming panel each having four extension panels which extend from and are foldably connected to the ends of said rectangular bottom wall sub-panels, at least the outermost pairs of the extension panels being foldably connected to each other, said first side wall forming panel having at each end thereof at least a portion of said first and second end wall forming panels, each of the latter two portions being adjacent to a respective one of the outermost four extension panels, the innermost of the four bottom wall sub-panels adapted to form the bottom of the erected container, the outermost of the four bottom wall sub-panels adapted to be glued to the interior edges of the side walls of the container to thereby space the bottom wall of the erected container from the bottom edges of the side and end walls of the container, said second side wall forming panel being connected at one end thereof to a portion of the first end wall forming panel.

5. The one-piece blank of claim 4 wherein adjacent pairs of the outermost pairs of extenson panels are foldably connected to each other by a fold line commencing at the ends of the four said bottom wall sub-panels and extending at an angle of about 45° with respect to said parallel fold lines in the bottom forming panel, the orientation of each of said about 45° fold lines being such that if extended, they would meet beyond the ends of the bottom forming panel.

6. The one-piece blank of claim 5 wherein the innermost of the four extension panels at each end of the bottom forming panel are of an axial extent, measured along the longest sides of the bottom forming panel, less than the axial extent of the outermost of these extension panels.

7. The one-piece blank of claim 5 wherein the innermost pairs of extension panels are foldably connected to each other.

* * * * *